US009681499B2

(12) United States Patent
Haamer et al.

(10) Patent No.: US 9,681,499 B2
(45) Date of Patent: Jun. 13, 2017

(54) FOOD PACKAGE

(75) Inventors: Joel Haamer, Nösund (SE); Martin Gustavsson, Escaldes-Engordany (AD)

(73) Assignee: Micvac AB, Mölndal (SE)

( * ) Notice: Subject to any disclaimer, the term of this patent is extended or adjusted under 35 U.S.C. 154(b) by 45 days.

(21) Appl. No.: 14/128,039

(22) PCT Filed: Jun. 28, 2012

(86) PCT No.: PCT/EP2012/062565
§ 371 (c)(1),
(2), (4) Date: Feb. 24, 2014

(87) PCT Pub. No.: WO2013/004586
PCT Pub. Date: Jan. 10, 2013

(65) Prior Publication Data

US 2014/0197162 A1 Jul. 17, 2014

(30) Foreign Application Priority Data

Jul. 6, 2011 (EP) ..... 11172853

(51) Int. Cl.
*H05B 6/64* (2006.01)
*B65D 77/22* (2006.01)
*B65D 81/34* (2006.01)

(52) U.S. Cl.
CPC ..... *H05B 6/6408* (2013.01); *B65D 77/225* (2013.01); *B65D 81/3453* (2013.01); *B65D 2205/00* (2013.01)

(58) Field of Classification Search
CPC ..... H05B 6/6408; B65D 33/01; B65D 33/16; B65D 77/225; B65D 81/3453; B65D 2205/00

(Continued)

(56) References Cited

U.S. PATENT DOCUMENTS 5,894,929 A * 4/1999 Kai ..... B65D 81/3461 206/524.8
2007/0090109 A1* 4/2007 Gustavsson ..... B65D 77/225 220/203.27

FOREIGN PATENT DOCUMENTS

| | | |
|---|---|---|
| EP | 2272661 | 1/2011 |
| WO | WO03026892 | 4/2003 |
| WO | WO2004106190 | 12/2004 |

OTHER PUBLICATIONS

Heiko Segerer, International Search Report for PCT Application PCT/EP2012/062565, Aug. 27, 2012, Rijswijk NL.

* cited by examiner

*Primary Examiner* — Brian Jennison
(74) *Attorney, Agent, or Firm* — Babcock IP, PLLC

(57) ABSTRACT

The present invention relates to a food package for cooking, storing and heating of ready-to-eat food. The food package comprises a food container (65), a plastic film (26) for sealing the food package from ambient air and being provided with an opening (16), said food package further comprising an openable and resealable valve membrane (52, 62) of a thermoelastic material covering said opening, wherein an adhesion between the valve membrane (52, 62) and the surface it is applied on is lower in a first area (160) than in a second area, wherein said first area (160) extends in a direction at least between said opening (16) of said plastic film and an edge of said valve membrane (52, 62), such that a canal (60) may be created between said opening (16) and a valve membrane periphery during cooking and/or heating of said ready-to-eat food, wherein the valve membrane has a production machine direction (8) of the thermoelastic material which has a relationship to said direction of said first area such that an angle therebetween is within an interval of 60° to 90°.

15 Claims, 3 Drawing Sheets

(58) Field of Classification Search
USPC ..... 219/735; 383/45, 63, 100, 103, 105
See application file for complete search history.

FOOD PACKAGE

FIELD OF THE INVENTION

The present invention relates to a food package for cooking, storing and heating of ready-to-eat food. The food package comprises a food container, a plastic film for sealing the food package from ambient air and being provided with an opening, said food package further comprising an openable and resealable valve membrane of a thermoelastic material covering said opening.

The present invention also relates to a valve membrane to be used in relation to a food package and a method of producing such a valve membrane.

BACKGROUND OF THE INVENTION

Today more and more ready-to-eat food is sold in grocery stores. Such meals are either frozen or refrigerated in order to have a reasonable long shelf life. Frozen food may be regarded as less tasty and looking less appetizing, while refrigerated food may be stored for a shorter period of time before being eaten. In order to prolong the shelf life for such refrigerated ready-to-eat food pasteurisation is used. Pasteurisation is combined with a removal of oxygen from the interior of the package in order to minimise bacterial growth. Such removal of oxygen may be either of creating a slight vacuum or the replacement of the oxygen by some other suitable gas.

In a cooking and pasteurisation method used by the applicant the food is placed in a plastic tray and is provided with a plastic cover in the form of a see-through thin film which is sealed along the tray edges to create an interior which is completely sealed off from the surroundings. In this plastic film a valve is created which may be automatically opened when an overpressure occurs within the package. Such overpressures are e.g. created when the package is positioned in a microwave oven and the food is cooked by exposing it to electromagnetic radiation. It may also be created through convection in e.g. furnaces with air heating and steam, or by exposing the package to thermal radiation, e.g. through infra-red radiation. When the food is cooked, a large amount of steam is created. The steam is building up an overpressure such that the valve is opening and letting both oxygen and steam out. When the food is cooked the microwave oven is shut off, whereby the steam production instantaneously stops. The valve is then designed to close immediately due to the reduction of internal overpressure and the lowering of the ambient temperatures. The food packages are cooled to a suitable storing temperature and may be delivered to retailers for later use. The overpressure of the kind when the valve opens in such food packages is quite high, in the region of 100 hPa, in comparison to i.a. a valve used in connection with packages such as for coffee, in which the overpressure is just slightly above atmosphere pressure.

The closure of the valve after cooking is important in order to seal the interior of the package and food from ambient air and contaminating substances. The valve must hence be designed such that it is certain that it is not affected by i.a. food residuals or moisture that may be blown into the valve during cooking.

One important closing feature of the valve on the plastic film is the ability to limit the formation of wrinkles in the material and bubbles between the different layers of valve and/or film after cooking and during resealing of the food package. The valve is usually connected to the film by an adhesive, and this adhesive must withstand a quite malicious treatment during the life cycle of the food package. However, so far there is still a too large risk for such formation and the present invention is aiming at further reducing such formation.

Another important feature of the valve is that it must also remain on the plastic film and not tend to fall off during cooking or handling. A reliable fastening of the valve to the plastic film may involve rather complicated, and thereby costly, production processes. It is therefore also an aim of the present invention to provide a valve that may be reliably fastened to the plastic film of the food package in a manner that is less complicated, as compared to previously known valves.

SUMMARY OF THE INVENTION

The present invention provides a valve that limits the formation of wrinkles in the material and bubbles between the different layers of the valve and/or the film on which the valve is applied. The present invention also provides a method for producing a valve having characteristics that limits the formation of wrinkles in the plastic material and bubbles between the different layers of the valve and/or the film on which the valve is applied. Furthermore, the present invention also provides a valve that may be attached to a plastic film in a manner that does not require such complex production manners as previously known valves.

According to at least a first aspect of the present invention, a food package for cooking, storing and heating of ready-to-eat food is provided. The food package comprises a food container, a plastic film for sealing the food package from ambient air and being provided with an opening, said food package further comprising an openable and resealable valve membrane of a thermoelastic material covering said opening, wherein an adhesion between the valve membrane and the surface it is applied on is lower in a first area than in a second area, wherein said first area extends in a direction at least between said opening of said plastic film and an edge of said valve membrane, such that a canal may be created between said opening and a valve membrane periphery during cooking and/or heating of said ready-to-eat food, wherein the valve membrane has a production machine direction of the thermoelastic material which has a relationship to said direction of said first area such that an angle therebetween is within an interval of 60° to 90°.

When the food in said food package is heated, either when the food is being cooked or when it is finally heated preparatory to consumption, steam is created. When steam is created, the purpose of the valve is that it should open and release the steam from the package and when the heating process is stopped, the valve should close in order to assist in preventing the food from being contaminated.

A certain adhesion between the first area and the surface it is applied on may be beneficial since it assists in closing the valve, which prevents contamination of the food when it is not being cooked or heated. However, it is also beneficial if the adhesion is not too large, since the canal should be allowed to be created when the food package is being subjected to heat.

Thermoplastic and thermoelastic polymer materials that have been processed into films and other shapes end up oriented with the machine direction of the processing equipment. This orientation stretches the polymers away from the entropically preferred "random coil"-state towards a "line-state". Upon exposure to heat, the polymers gain motion and will return to the entropically preferred state, called relaxation.

The present invention is based on the finding that if the first area has an angle in relation to the machine direction of the polymers that is within an interval of 60° to 90°, the relaxation will actually tighten the canal during steam release, and thereby reduce the risk of wrinkle formation. This way the canal may be made shorter whereby the valve may be made smaller and not hindering visibility of the food within the package.

The second area of the valve membrane, i.e. the area having stronger adhesion to the surface it is applied on should preferably not be released from the plastic film during cooking and/or heating of the food in the package. Due to the tightening of the canal during steam release which provides a reliable closing of the valve, the adhesion between the first area and the surface it is applied on may be lower, as compared to prior art valves in which the adhesion had to be greater in order to provide a reliable closing. A benefit of having lower adhesion in the first area is that the pressure required to open the canal becomes lower. The fact that the opening pressure of the canal is lower has the effect that the demands on the method employed for fastening the valve membrane to the plastic film is lower, which provides for simplified fastening of the valve membrane to the plastic film of the food package. Lesser demands on the method of fastening the valve membrane to the plastic film is beneficial in terms of production costs.

According to one exemplary embodiment, said interval for the angle between the machine direction of the thermoelastic material and the extension of said first area is 75° to 90°.

According to one exemplary embodiment, said interval for the angle between the machine direction of the thermoelastic material and the extension of said first area is 85° to 90°, and most preferred 90°.

It may according to this embodiment be suitable to provide the first area so that the canal extends substantially perpendicular to the machine direction of the thermoelastic material of the valve membrane. A substantially perpendicular relationship between the machine direction of the thermoelastic material and the extension of said first area may be beneficial since the material my then, when it is subject to relaxation, tighten the canal even more, and hence provide for a more reliable closing of the valve.

According to one exemplary embodiment, said first area comprises a first sub-area and a second sub-area, wherein the adhesion is lower in the first sub-area than in the second sub-area.

According to one exemplary embodiment, the first sub-area is provided so that it, when the valve membrane is applied to the food package, surrounds the opening in said plastic film.

According to one exemplary embodiment, the second sub-area extends from said first sub-area to an edge of said valve membrane.

The edge of the valve membrane mentioned for the exemplary embodiments above is the edge of the valve membrane that in use will constitute the outlet opening of the canal. Providing sub-areas having different adhesive properties within the first area provides for a valve that may more easily opens when the pressure increases in the food package.

According to one exemplary embodiment, said adhesion is achieved by an adhesive. Hence, in this embodiment, the valve is fastened to the plastic film by means of adhesive. Providing an adhesive holding the valve membrane, either directly or indirectly, to the plastic film, is beneficial in terms of less complicated production methods.

According to one exemplary embodiment, different adhesives are being used at the first area and the second area, respectively, in order to create different degrees of adhesion for the different areas.

According to one exemplary embodiment, said lower adhesion is achieved by a release coating.

Providing adhesive and release coating at said first area in order to create an area having lower adhesion to the plastic film may be beneficial. In this exemplary embodiment, the same adhesive may be applied to the entire valve membrane, and thereafter release coating is applied to the first area in order to lower the adhesion of that area. Hence, when the release coating is applied so that it covers the adhesive of the first area, the adhesive properties of the adhesive is lowered in that area.

According to one exemplary embodiment, release coating within an interval of 50-100% is applied on the adhesive of said first sub-area. According to one exemplary embodiment, release coating within an interval of 75-100% is applied to the adhesive of said first sub-area. According to one exemplary embodiment, release coating amounting to 100% is applied to the adhesive of the first sub-area.

According to one exemplary embodiment, release coating within an interval of 25-75% is applied to the adhesive of said second sub-area. According to one exemplary embodiment, release coating within an interval of 40-60% is applied to the adhesive of said second sub-area. According to one exemplary embodiment, the release coating amounting to 50% is applied to the adhesive of the second sub-area.

According to one exemplary embodiment, the amount of release coating in the first sub-area is approximately twice as much as the amount of release coating in the second sub-area.

The different intervals above relates to the method of applying release coating, where 100% denotes the maximum amount of release coating applied using that production method. Suitably, when 100% release coating is applied on the first sub-area, the adhesive will still provide a slight adhesion between the valve membrane and the surface it is applied on.

Providing release coating within the different intervals mentioned above for the different embodiments, respectively, provides for a valve that has adhesive properties adapted so that it easily opens when the pressure increases in the food package, while it at the same times provides for a reliable closing of the valve when it is not subject to heating.

According to one exemplary embodiment, the shape of the first area is in the form of a truncated cone, having its largest width at the edge of the valve membrane. A more narrow width of the canal between the valve membrane and the surface it is applied on, closer to the opening in the plastic film, as compared to the width of the canal at the edge of the valve membrane, may be beneficial. The reason for this being that it provides for a more reliable closing of the valve.

According to one exemplary embodiment, said release coating is printed on said adhesive.

Printing said release coating on the adhesive in said first area may be beneficial in order to direct the extension of said first area within the intervals given for the angle in relation to the machine direction of said valve membrane for the different exemplary embodiments mentioned above.

According to one exemplary embodiment, said release coating is sprayed on said adhesive. Spraying release coating on the adhesive in said first area is another beneficial manner in providing release coating in a first area having a desired extension in relation to the machine direction of the valve membrane.

According to one exemplary embodiment, said release coating is applied on the surface on which said valve membrane is applied.

According to one exemplary embodiment, said release coating is printed on the surface on which said valve membrane is applied.

Instead of applying the release coating on the first area of said valve membrane, it is possible to apply the release coating on the corresponding surface on which the valve membrane is applied. Hence, when the valve membrane is applied on that surface, the first area of the valve membrane will come into contact with the release coating and the adhesion will thereby become lower in the first area than in the second area. It is for example conceivable to print the release coating on that surface. It is also conceivable to, in a similar manner, spray the release coating on the surface on which the valve membrane is applied.

Also for this embodiment is it possible to utilize different sub-areas having different adhesive properties, as described above for some exemplary embodiments.

According to one exemplary embodiment, said release coating is a silicone based substance.

A silicone based substance, such as e.g. silicone oil is a beneficial substance to use as release coating. However, other alternatives also exist. The purpose of the release coating is that the substance being used shall reduce the adhesive properties of the adhesive, and any substance or material fulfilling that purpose and that is able to be applied on the adhesive in a controlled manner by e.g. printing or spraying may suitably be used.

According to one exemplary embodiment, said thermoelastic material is in an elastic state at temperatures exceeding 30° C.

The intended purpose of the valve is that it should open when the food package is subjected to heating, and steam thereby is created, and close when there is no more steam within the food package. It may therefore be advantageous to use thermoelastic materials being in its elastic state at temperatures exceeding 30° C. Hence, when the food package is being stored, such as in a refrigerator, the valve membrane is not in its elastic state. This provides for a reliable closing of the valve.

According to one exemplary embodiment, said valve membrane is applied directly on said plastic film. According to this exemplary embodiment, the canal will be created between the plastic film and the valve membrane.

According to one exemplary embodiment, said plastic film is provided with a valve seat, wherein said valve seat is provided by a first layer being applied to said plastic film and having an opening in register with said opening of the plastic film, and wherein said valve membrane is applied on said valve seat. According to this exemplary embodiment, the valve membrane covers both the opening in the plastic film and the opening in the first layer.

According to this exemplary embodiment, the canal will be created between the valve seat and the valve membrane.

According to one exemplary embodiment, said first layer is provided with adhesive on its surface being directed towards said plastic film. Said first layer, i.e. the valve seat, may then be steadily attached to the plastic film.

According to one exemplary embodiment, the valve membrane is formed by a material being more elastic than the surface it is applied on. The surface it is applied on may either be the plastic film covering the food package, or a valve seat in the form of a first adhesive layer. By providing the valve membrane in the form of a more elastic material, a bubble will then be able to form in the valve membrane above the opening of the plastic film when a pressure is created in the food package. After the bubble has been initiated, and the pressure continues, a gap will be created and the valve will subsequently open from the opening of the plastic film to the edge of the valve membrane, along the first area of the valve membrane.

According to one exemplary embodiment, the valve membrane has a substantially rectangular shape comprising two shorter sides and two longer sides.

According to one exemplary embodiment, the length of the longer sides are between 1 and 7 cm, more preferred between 1.5 and 5 cm, and most preferred between 3 and 4 cm. According to one exemplary embodiment, the length of the shorter sides are between 1 and 6 cm, more preferred between 1.5 and 4.5 cm, and most preferred between 2.5 and 3.5 cm. According to one exemplary embodiment, the lengths of the longer sides and the shorter sides, respectively, are between 0.5 and 20 cm, more preferred between 1 and 15 cm, and most preferred between 1.5 and 10 cm.

According to one exemplary embodiment, the valve membrane has a substantially quadratic form. According to one exemplary embodiment, the length of the sides are between 1 and 7 cm, more preferred between 1.5 and 5 cm, and most preferred between 3 and 4 cm. According to one exemplary embodiment, the lengths of the sides are between 0.5 and 20 cm, more preferred between 1 and 15 cm, and most preferred between 1.5 and 10 cm.

Owing to the configurations mentioned above the manufacturing costs may be comparatively low, since it allows the valves to be manufactured in a manner identical to that of a long strip of labels.

According to a second aspect of said invention, a valve membrane of a thermoelastic material for use in a food package for cooking, storing and heating of ready-to-eat food is provided. Said valve membrane being provided with an adhesive such that the adhesive properties in a first area is lower than the adhesive properties in a second area, wherein said first area extends in a direction from an edge of said valve membrane and to a position on the surface of said valve membrane spaced from the periphery of said valve membrane, wherein in use of the valve membrane a canal may be created along said first area, wherein the valve membrane has a production machine direction of the thermoelastic material which has a relationship to said direction of said first area such that an angle therebetween is within an interval of 60° to 90°.

A valve membrane according to the second aspect of the present invention may suitable be used in a food package according to any one of the exemplary embodiments of the first aspect of the present invention. A valve membrane according to the second aspect of the present invention may suitably have similar characteristics as defined for the different exemplary embodiments of the first aspect of the present invention.

According to a third aspect of the present invention, a method of producing a valve membrane for use in a food package for cooking, storing and heating of ready-to-eat food is provided. The method comprising providing a valve membrane of thermoelastic material with an adhesive on one side thereof;

apply release coating on a first area of said valve membrane, such that said first area extends in a direction from an edge of said valve membrane to a position on the surface of said valve membrane being spaced from the periphery of said valve membrane, wherein the direction of said first area has a relationship to the production machine direction of said valve membrane so that an angle therebetween is within an interval of 60° to 90°.

According to one exemplary embodiment, said release coating is applied on a first area having an extension with an angle of 75° to 90° in relation to the production machine direction of said valve membrane.

According to one exemplary embodiment, said angle is within an interval of 85° to 90°.

According to one exemplary embodiment, said angle is 90°.

By providing the surface of the valve membrane with an adhesive, and thereafter apply release coating on the first area of the valve membrane, it is possible to decide the relationship between the extension of the first area and the machine direction of the polymers so that a favourable orientation is achieved.

According to one exemplary embodiment, said release coating is printed on said first area.

According to one exemplary embodiment, said valve membrane is fastened to a plastic film of a food package by means of adhesive. The fastening of the valve membrane to the plastic film may be either directly, or indirectly. By indirect fastening is meant to understand that the valve membrane is fastened to e.g. a first layer, that is fastened to the plastic film of the food package.

According to one exemplary embodiment, said valve membrane may be fastened to a first layer before being attached to said plastic film. According to one other exemplary embodiment, the first layer is first attached to said plastic film, and thereafter, the valve membrane is fastened to said first layer.

According to one exemplary embodiment, said release coating is a silicone based substance. A silicone based substance, such as e.g. silicone oil is a beneficial substance to use as release coating. However, other alternatives also exist. The purpose of the release coating is that the substance being used shall reduce the adhesive properties of the adhesive, and any substance or material fulfilling that purpose and that is able to be applied on the adhesive in a controlled manner by e.g. printing may suitably be used.

According to one exemplary embodiment, said valve membrane is applied to a plastic film covering a food package, by means of said adhesive.

The method of manufacturing a valve membrane illustrated in the exemplary embodiments above may suitably be used in order to manufacture a valve membrane according to the second aspect of the present invention. By attaching, either directly or indirectly, the valve membrane produced according to the exemplary embodiments mentioned above to a food package, a food package according to the first aspect of the present invention may suitably be manufactured. Preferably, when attaching the valve membrane to a food package, the valve membrane should be positioned so that it covers an opening of the plastic film of the food package, with the portion of the first area of the valve membrane being distanced from an edge of said valve membrane being positioned so that it is covers or is directly adjacent the opening of the plastic film.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, wherein.

DETAILED DESCRIPTION OF EXEMPLARY EMBODIMENTS

Figure 1A:
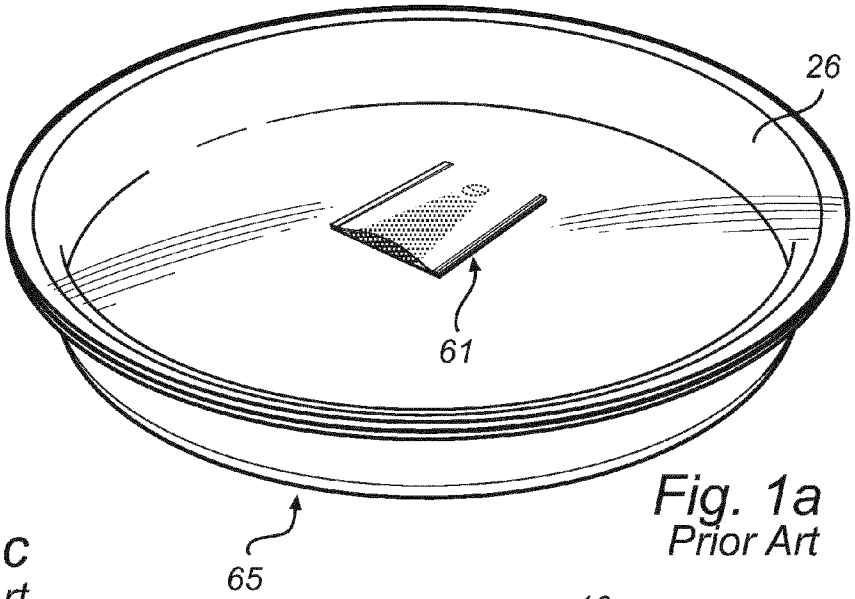
Fig. 1a Prior Art
FIGS. 1*a*-1*d* illustrate a prior art valve.

The present invention will now be described more fully hereinafter with reference to the accompanying drawings, in which exemplary embodiments of the invention are shown. The invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout the description.

In the following description, the present invention is described with reference to a food package having a plastic tray covered with a plastic film on which a valve is arranged. It is however to be understood that any package able to contain food may be used, such as a plastic bag. The materials of the food package are also exchangeable as long as the characteristics and behaviour is maintained as described.

Now turning to FIGS. 1*a* to 1*d* describing a known food package, in which 65 denotes a plastic tray in which the food is to be contained. 61 denotes a valve and 26 a plastic film onto which the valve 61 is fastened and which is connected to the rim of the tray such that the surrounding is sealed off from the contents of the package. In this particular case the valve 61 is a rectangular two layer valve having a bottom layer 17 connecting strongly over its full area to the film 26 and a top layer 12 in which a portion has a slightly lower adhesion to the bottom layer 17 in comparison to the adjacent areas, at least at the edges 19. By this a canal 10 is created between the top layer 12 and the bottom layer 17 when the food package is heated.

The edges 19 of the top layer 12 and the bottom layer 17 are welded together by a weld seam 14 and the bottom layer are fastened to the plastic film by e.g. adhesive 13. The reason the edges are welded together is that they must be able to withstand the high pressures generated in the food package before the canal of the valve opens, since otherwise, the steam may exit in a non-desired way.

Figure 1B:
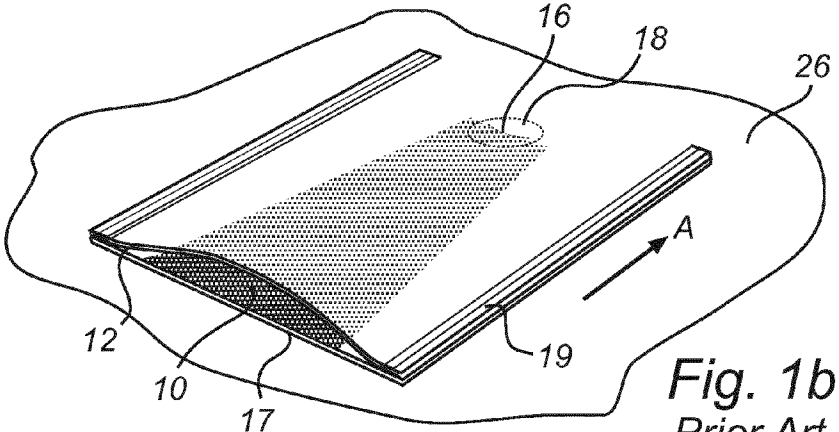
Fig. 1b Prior Art
Figure 1C:
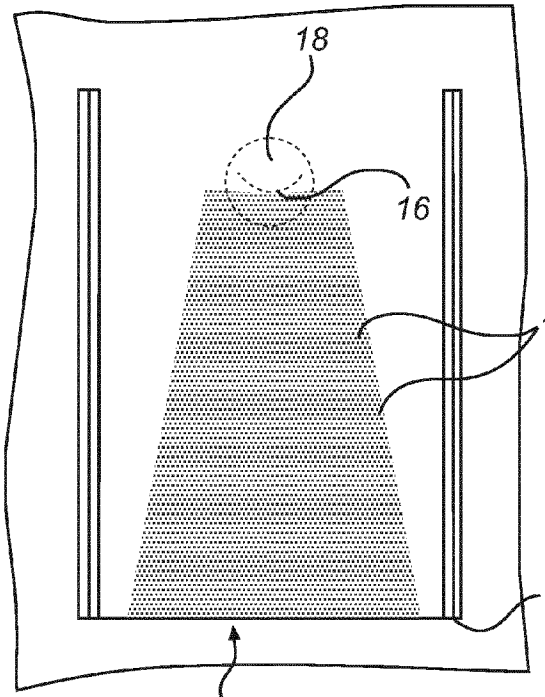
Fig. 1c Prior Art
Figure 1D:
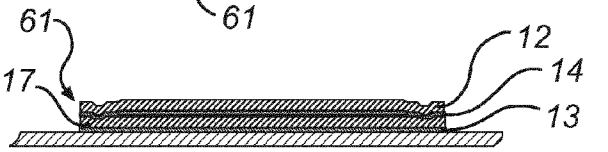
Fig. 1d Prior Art

This canal 10 may be formed by either a less adherent adhesive, or by applying a release coating to the canal 10 to the similar effect. An aperture 16 is made in the film 26 which is put in register with a hole 18 in the bottom layer 17 of the valve 17 such that air and steam from within the package may escape through the aperture 16 and the hole 18 and out through the canal 10. In FIG. 1*b* the valve 61 is seen in an open condition and in FIG. 1*c* the valve 61 is seen in a top view, whereas in FIG. 1*d* the valve 61 is fully closed.

The valve according to the prior art is conventionally made in a so called roll-to-roll production manner. In this production manner, the valve membranes are processed and provided by adhesive and release coating in the machine direction of the polymers. The machine direction is illustrated by arrow A in FIG. 1*b*, and as can be seen, the canal 10 extends in the machine direction. In order to achieve a reliable seam between the first layer and the valve membrane, the welding must be performed in an area where no adhesive is provided. Because of this, the adhesive and the area with release coating must be provided in the machine direction of the polymers.

Figure 2:
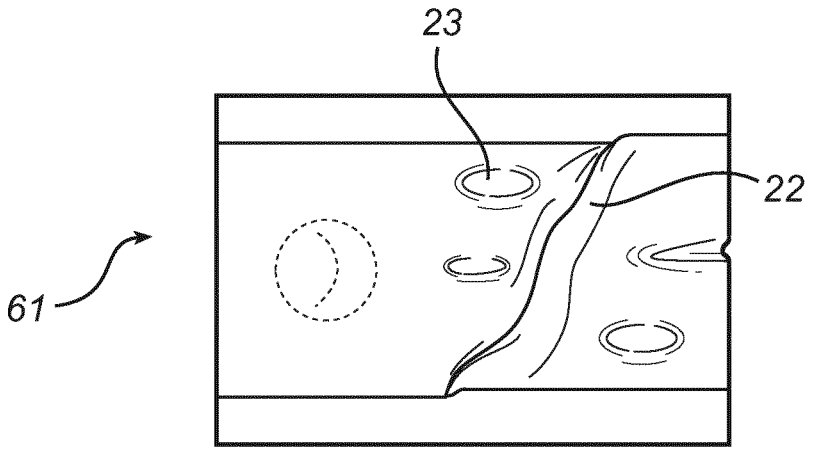
FIG. 2 schematically illustrates a prior art valve after processing of food.

In FIG. 2 a similar valve 61 as in FIGS. 1*a* to 1*d* is shown in a schematical manner showing how wrinkles 22 and bubbles 23 are formed in the canal 10 after cooking in a microwave oven and during resealing of the valve 61. In order to hermetically seal the interior of the package from the surroundings at least one line of full adhesion must be formed from one side of the canal 10 to the other side. To achieve such a hermetical seal to a certain probability level, the canal 10 has to be rather long, resulting in the use of more material and a clumsier valve 61 which also reduces the visibility of the food within the package. Thermoplastic and thermoelastic polymer materials that have been processed into films and other shapes end up oriented with the machine direction of the processing equipment. This orientation stretches the polymers away from the entropically preferred "random coil"-state towards a "line"-state. The random coil-state has the two ends of the polymer close to each other, thus enabling the highest possible combinations of shapes and positions of the links in the chain (highest entrophy). The mechanical force that drives the films through the machines stretches the polymers away from this configuration. Upon exposure to heat, the polymers gain motion and will return to the entropically preferred state, called relaxation. The degree of orientation determines the percentage of shrink achieved.

Figure 3:
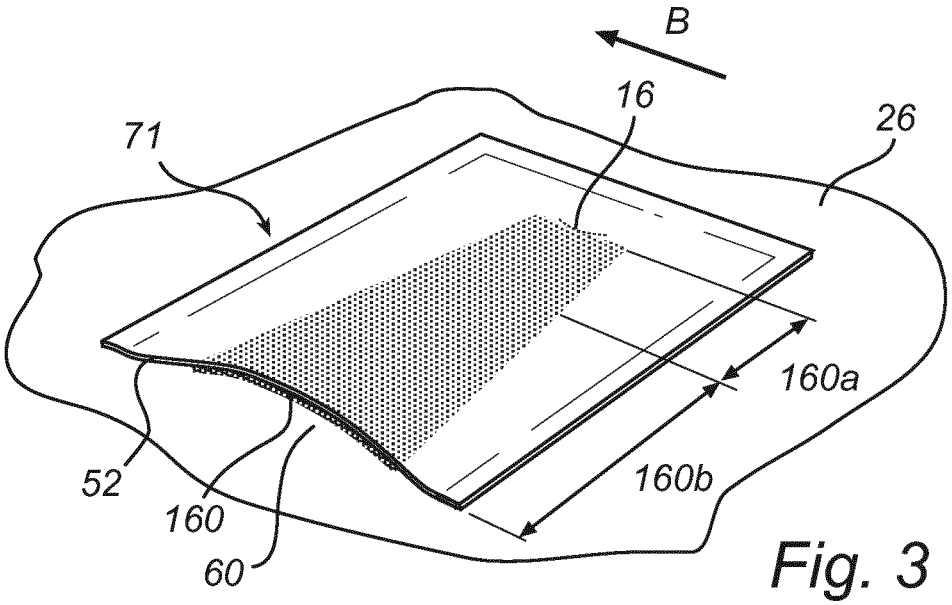
FIG. 3 illustrates an exemplary embodiment of a valve according to the present invention.
Figure 4A:
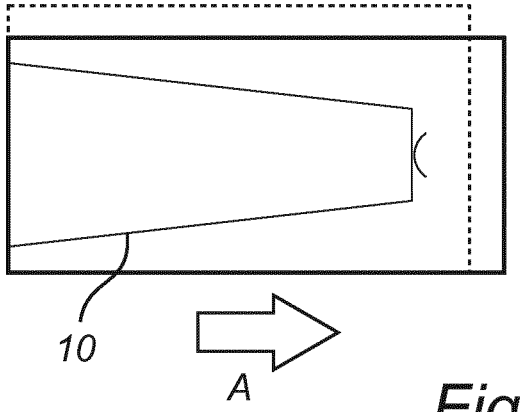
FIGS. 4*a*-4*b* schematically illustrate relaxation of polymer sheets as a function of machine direction.
Figure 4B:
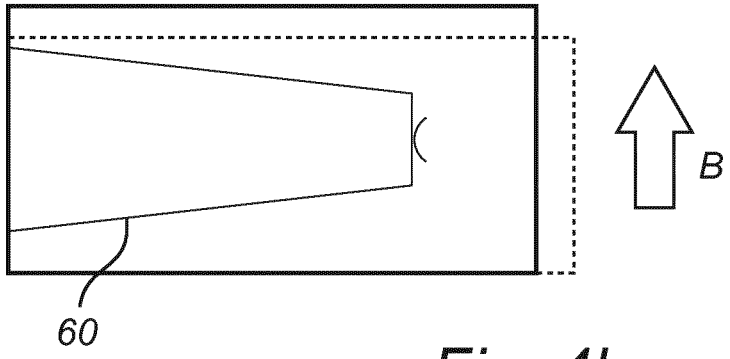

FIGS. 4*a* and 4*b* illustrate how a slightly single direction oriented polymer material relaxes upon heat treatment. A full line representing a state before heat treatment and a dotted line representing a state after heat treatment. The arrows A and B, respectively and similar to FIGS. 1*b*, 3 and 5, indicates the orientation direction of the polymers.

FIGS. 4*a* and 4*b* help explaining how the wrinkles in the valve 61 in FIG. 2 arise. If steam is released along the machine direction of the polymers during cooking, i.e. forced by the way the canal 10 is achieved through coating of different adhesives and/or release coating, giving the canal 10 a main direction, the situation in FIG. 4*a* applies. It means that the thermoelastic material of the valve membrane relaxes in a non-desired manner. The width of the canal 10 would increase, and due to being adhered to the film 26 of the package 65, this expansion would be held back. It would consequently result in wrinkle formation, since the width of the canal 10 is prevented from expanding freely.

A FIG. 4*b*-situation would instead be desired, and is the idea behind the present invention, as the relaxation tightens the canal 10 during steam release, hence increasing the force required to keep the canal open, i.e. increasing the closing pressure of the valve, eliminating the risk of wrinkle formation, and improving the sealing ability of the valve.

An exemplary embodiment of the present invention is disclosed in FIG. 3. A plastic tray (not shown) is covered by a film 26. In the plastic film an opening 16 in the form of a semi-circular slit is formed through said film 26. A valve 71 is created by placing a rectangular valve membrane 52 on top of the plastic film 26 such that it fully covers said aperture 16. The valve membrane is in this embodiment a one layer membrane, although one or several layers may be employed at the choice of the user and his or her particular needs. The valve membrane is during production provided with an adhesive over the full area thereof, which adhesive attaches the valve membrane to the plastic film. In order to create a first area 160 having lower adhesion to the film 26, in order to direct the air and steam from within the package and to lower and to control the opening pressure so that a canal 60 may be created, release coating is placed on the adhesive in first area 160 in order to reduce the adhesion to the film. In an exemplary embodiment of the invention this is achieved by printing the release coating on the desired area of the valve membrane. Thereafter the valve membrane is placed on the film 26 after the punching of a slit constituting the aperture 16. In a following step the film with the resulting valve 61 may be placed and fastened to the tray 65.

In this embodiment, the release coating is printed, or otherwise placed, on the valve membrane so that the first area 160, and thereby the canal 60, extends from the opening 16 to an edge of the valve membrane in a direction being substantially perpendicular to the machine direction, illustrated by arrow B, of the valve membrane. The areas of the valve membrane outside the first area, are not provided with any release coating in order to ensure a reliable fastening of the valve membrane to the plastic film.

The first area may be divided into several sub-areas 160*a*, 160*b*, wherein each sub-area may be provided with different amounts of release coating. For example, the sub-area 160*a* closest to the slit 16 of the plastic film may be provided with more release coating than the sub-area 160*b* of the first area being furthest away from the slit. By this, a valve that easily opens and that at the same time provides a reliable closing may be achieved.

It is also conceivable that the release coating is instead printed or applied in any other suitable manner on the desired area of the film 26, before the valve membrane is placed on the film. By this, the adhesive on the valve membrane will come into contact with the release coating when the valve membrane is applied to the film. Also in this method of applying the release coating, different sub-areas may be provided with different amounts of release coating. It is also conceivable to combine the two exemplary embodiments of applying the release coating to the desired area of the valve. Hence, it is possible to print release coating on both the valve membrane 52 and the film 26.

Figure 5:
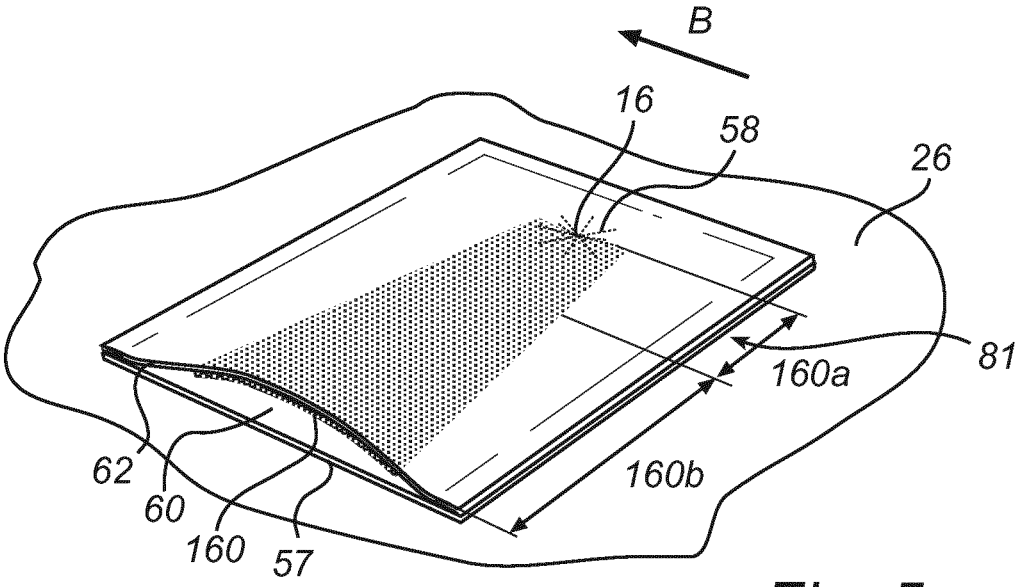
FIG. 5 illustrate another exemplary embodiment of the present invention.

FIG. 5 illustrate another exemplary embodiment of the present invention. In this embodiment, the valve 81 is a two-layer valve. Between the plastic film 26 covering the plastic tray and the valve membrane 62 is a first adhesive layer 57 provided. The first adhesive layer 57 is provided with an adhesive on its entire surface being directed against the plastic film 26, ensuring a reliable fastening of the first adhesive layer to the plastic film. The first adhesive layer is provided with an opening 58 in the form of a star-shaped slit enclosing the aperture 16 formed in the plastic film. The surface of the first adhesive layer being directed against the valve membrane is not provided with any adhesive. Instead, the valve membrane 62 is, in a manner similar to the exemplary embodiment described in relation to FIG. 3, provided with adhesive over the full area thereof. Also in a manner similar to the embodiment disclosed in FIG. 3, a selected first area 160 of the valve membrane 62 has been provided with a release coating in order to reduce the adhesion of the valve membrane 62 to the first adhesive layer 57. A canal 60 may then, when the food package is subjected to heating and steam is created, be created between the first adhesive layer and the valve membrane at the area 160 where the release coating has been applied. Also in this embodiment is the extension of the first area 160, and thereby the canal 60, substantially perpendicular to the machine direction B of the valve membrane.

The first area 160 may comprise different sub-areas 160*a*, 160*b* having different adhesive properties. For example and similar to what has been described in relation to FIG. 3, the sub-area 160*a* closest to the slit 16 of the plastic film may be provided with more release coating than the sub-area 160*b* of the first area being furthest away from the slit.

It is also conceivable that the release coating is instead printed or applied in any other suitable manner on the desired area of the first adhesive layer 57, before the valve membrane is placed on the first adhesive layer. It is also conceivable to combine the two exemplary embodiments of applying the release coating to the desired area of the valve. Hence, it is possible to print release coating on both the valve membrane 62 and the first adhesive layer 57.

The valve membranes 62 in the exemplary embodiments above are fastened to the plastic film 26 and the first layer 57 by means of adhesive. This is in contrast to the prior art valves that were welded together or to the plastic film on which they are applied. Due to the improved closing of the valves provided by the angled relationship between the first area of the valve and the machine direction of the polymer materials, respectively, a more reliable closing is achieved. Due to this improved closing, the adhesion between the valve membrane and the surface it is applied on may be lower than for prior art valves. This may be achieved by either using a less adherent adhesive or by providing more release coating, as compared to prior art valves. Due to this lower adhesion, the pressure required to open the valve is lower, and the fastening between the valve membrane and the plastic film and/or the first layer need therefore not be able to withstand as high pressures as was the situation with prior art valves.

The valves 71 and 81, illustrated in FIGS. 3 and 5, respectively, consequently opens once a critical overpressure has been reached that exceeds the strength of the adhesive in the first area at a given temperature. The opening pressure is typically 10-200 mbar at 70-100 C. Once the valve opens, steam escapes through the canal 10 throughout the process, typically 5-50 g of steam. The thermoelastic valve material is in its elastic state at the elevated temperatures which occur in the end of the cooking process of the food within the package, typically at 90-100 C. It means the elasticity of the material forces the valve membrane back towards the film 26 of the package 65. To maintain the canal open, a certain overpressure is required. Once this overpressure falls below a threshold level, typically 3-5 mbar, the elastic force of the plastic valve membrane material closes the canal and the valve membrane seals the same as the temperature drops.

The material used for the valve membranes 52, 62 is preferably a crystalline material with low crystallinity and a glass transition temperature above 25° C. but below 100° C. An example of such a material is e.g. polyvinyl chloride (PVC). A material having properties as described above allows the valve membrane to be processed, e.g. printed, die cut and labelled in room temperature, i.e. when the material is in its non-elastic condition. During the cooking process of the food, the valve membrane will transform to its elastic condition and start functioning as a valve. It is also conceivable to use other materials having similar properties, such as e.g. polyurethane rubber.

Although exemplary embodiments of the present invention have been described herein, it should be apparent to those having ordinary skill in the art that a number of changes, modifications or alterations to the invention as described herein may be made. Thus, the above description of the various embodiments of the present invention and the accompanying drawings are to be regarded as non-limiting examples of the invention and the scope of protection is defined by the appended claims.

For example, the opening in the plastic film and the first adhesive layer when appropriate does not need to have any specific shape, it may for example be a semi-circular slit, a star-shaped slit, a circular hole or a plurality of small holes.

The first adhesive layer 57 may be made in a similar manner as the valve membrane, i.e. processed in a roll-to-roll production. However, it may also be punched out from a thermoelastic material.

In the illustrated embodiments, the first layer and the valve membrane has been illustrated having substantially the same size. It is however also conceivable that the first layer cover a larger area than the valve membrane.

Furthermore, any reference signs in the claims should not be construed as limiting the scope.

We claim:

1. A food package for cooking, storing and heating of ready-to-eat food, the food package prepared by a process comprising steps of:

providing a food container, sealing the food package from ambient air with a plastic film;

the plastic film provided with an opening covered by a thermoelastic material to form an openable and resealable valve membrane, wherein an adhesion between the valve membrane and a surface of the plastic film proximate the opening which the thermoelastic material is applied on is lower in a first area than in a second area, wherein said first area extends in a direction at least between said opening of said plastic film and an edge of said valve membrane, such that a canal may be created between said opening and a valve membrane periphery during cooking and/or heating of said ready-to-eat food, wherein the valve membrane has a production machine direction of the thermoelastic material, along which polymers of the thermoelastic material are pre-stretched, which has a relationship to said direction of said first area such that an angle therebetween is within an interval of 60° to 90°.

2. A food package according to claim 1, in which said interval is 75° to 90°.

3. A food package according to claim 1, wherein said adhesion is provided by an adhesive.

4. A food package according to claim 1, wherein said lower adhesion is provided by a release coating.

5. A food package according to claim 4, wherein said release coating is printed on said adhesive.

6. A food package according to claim 4, wherein said release coating is printed on the surface on which said valve membrane is applied.

7. A food package according to claim 4, wherein said release coating is a silicone based substance.

8. A food package according to claim 1, wherein said thermoelastic material is in an elastic state at temperatures exceeding 30° C.

9. A food package according to claim 1, wherein said valve membrane is applied directly on said plastic film.

10. A food package according to claims 1, wherein said plastic film is provided with a valve seat, wherein said valve seat is provided by a first layer being applied to said plastic film and having an opening in register with said opening of the plastic film, and wherein said valve membrane is applied on said valve seat.

11. A food package according to claim 10, wherein said first layer is provided with adhesive on its surface being directed towards said plastic film.

12. A valve membrane of a thermoelastic material for use in a food package for cooking, storing and heating of ready-to-eat food, said valve membrane being provided with an adhesive such that the adhesive properties in a first area is lower than the adhesive properties in a second area, wherein said first area extends in a direction from an edge of said valve membrane and to a position on the surface of said valve membrane spaced from the periphery of said valve membrane, wherein in use of the valve membrane a canal may be created along said first area, wherein the valve membrane has a production machine direction of the thermoelastic material, along which polymers of the thermoelastic material are pre-stretched, which has a relationship to said direction of said first area such that an angle therebetween is within an interval of 60° to 90°.

13. A process of producing a valve membrane for use in a food package for cooking, storing and heating of ready-to-eat food, the process comprising:

providing a valve membrane of thermoelastic material with an adhesive on one side thereof;

applying a release coating on a first area of said valve membrane, such that said first area extends in a direction from an edge of said valve membrane to a position on the surface of said valve membrane being spaced from the periphery of said valve membrane, wherein the direction of said first area has a relationship to the production machine direction, along which polymers of the thermoelastic material are pre-stretched, of said valve membrane so that an angle therebetween is within an interval of 60° to 90°.

14. the process according to claim 13, wherein said release coating is a silicone based substance.

15. A valve membrane for use in a food package for cooking, storing and heating of ready-to-eat food, manufactured by the process of claim 13.

* * * * *